United States Patent [19]

Boatman et al.

[11] 4,207,702

[45] Jun. 17, 1980

[54] LIGHT TRANSMISSIVE FLYING SAUCER WITH CHEMICAL LIGHTSTICK

[75] Inventors: Martin R. Boatman; Phillip E. Robertson; Martin M. Gaughan, all of Kent, Wash.

[73] Assignee: Dynamic Toy Company, Inc., Seattle, Wash.

[21] Appl. No.: 898,705

[22] Filed: Apr. 24, 1978

[51] Int. Cl.[2] ..... A63H 27/00

[52] U.S. Cl. ..... 46/74 D; 46/228

[58] Field of Search ..... 46/74 D, 228, 229

[56] References Cited

U.S. PATENT DOCUMENTS

| | | | |
|---|---|---|---|
| 2,640,296 | 6/1953 | Johnson et al. | 46/74 D X |
| 4,086,723 | 5/1978 | Strawick | 46/74 D |
| 4,135,324 | 1/1979 | Miller | 46/228 X |

*Primary Examiner*—F. Barry Shay

*Attorney, Agent, or Firm*—Seed, Berry, Vernon & Baynham

[57] ABSTRACT

A saucer-shaped toy having a generally planar central portion, a relatively thick, downwardly depending rim and a mid-portion having a textured outer surface containing a series of spaced apart portholes or windows extending between the rim and central portion. A diametrically positioned, cylindrical cradle formed in the central portion is adapted to receive a chemical light-stick, and the light-stick is releasably secured in place by resilient retaining fingers. In use, illumination from the light-stick propagates through the toy to cause the toy to dramatically simulate fictionalized flying saucers and allows the toy to be used in low light conditions.

8 Claims, 3 Drawing Figures

LIGHT TRANSMISSIVE FLYING SAUCER WITH CHEMICAL LIGHTSTICK

BACKGROUND OF THE INVENTION

1. Field of the Invention

This invention relates to aerodynamic toys and, more particularly, to flying saucer-shaped toys.

2. Description of the Prior Art

Over the past several years toys resembling saucers have become quite popular as throwing implements. In the usual embodiment the implement is made of a plastic material in a saucer shape with a rim located around the edge of the saucer, the rim having a somewhat greater thickness then the saucer portion of the implement. The rim curves downwardly from the saucer and has a configuration such that the implement when viewed in elevation approximates the shape of an airfoil.

The toy is used in throwing games and is normally gripped by placing the thumb on the convex side of the saucer and one or more of the fingers on the concave side. Throwing is usually accomplished with a wrist snapping motion wherein the thrower assumes a stance approximately at right angles to the intended target and retracts his arm across his body. By uncoiling his arm and snapping his wrist, momentum and a spinning motion is imparted to the saucer to cause it to fly toward the target. The direction of flight from the thrower depends upon the thrower's skill and the type of flight path (e.g. curved or straight) depends upon the angle of the saucer relative to the ground when it is released by the thrower. Its appeal as a toy appears to reside in the fact that is exhibits definite aerodynamics characteristics, can be made to do maneuvers of various kinds depending upon the skill of the user, and is relatively easy to master.

While these commonly used flying saucer toys exhibit aerodynamic characteristics, they do not accurately simulate fictionalized flying saucers as illustrated in movies, television and the literature. In these fictionalized versions of flying saucers the saucer generates an eerie glow over substantially its entire surface, and its outer surface contains a series of contrasting portholes or windows through which space creatures may view such extraterrestrial curiosities as earthlings.

Another disadvantage of conventional flying saucer toys common to virtually all varieties of aerodynamic toys is that they generally may not be used under low light conditions since it is not possible for either the sender or receiver of the toy to visualize its flight path. Thus conventional flying saucer toys are generally daytime use devices.

SUMMARY OF THE INVENTION

It is an object of the invention to provide a flying saucer toy which realistically simulates fictionalized flying saucers.

It is another object of the invention to provide a flying saucer toy which may be used in low light conditions.

It is still another object of the invention to provide a flying saucer toy of the character described which retains its advantageous aerodynamic properties.

It is a further object of the invention to provide an illuminated flying saucer toy capable of utilizing commercially available chemical light source.

These and other objects of the invention are accomplished by mounting a commercially available chemical light source in the central portion of a flying saucer toy. The saucer toy is fabricated of a light transmissive material so that light from the light source propagates through the saucer causing the saucer to glow in a realistic manner. The light source may be a tubular light-stick mounted in an elongated cylindrical cradle diametrically positioned in the central portion of the toy. The light-stick is secured in place by a plurality of upstanding resilient fingers frictionally engaging the sidewalls of the light-stick. An annular mid-portion surrounding the central portion is provided with a textured outer surface to affect the distribution of light emanating from the toy in this area. A plurality of portholes having a smooth surface are spaced apart long the mid-portion. The portholes contrast sharply with the surrounding surface since the smooth surfaces of the portholes emit less light than the surrounding textured surface.

DETAILED DESCRIPTION OF THE PREFERRED EMBODIMENTS

Figure 1:
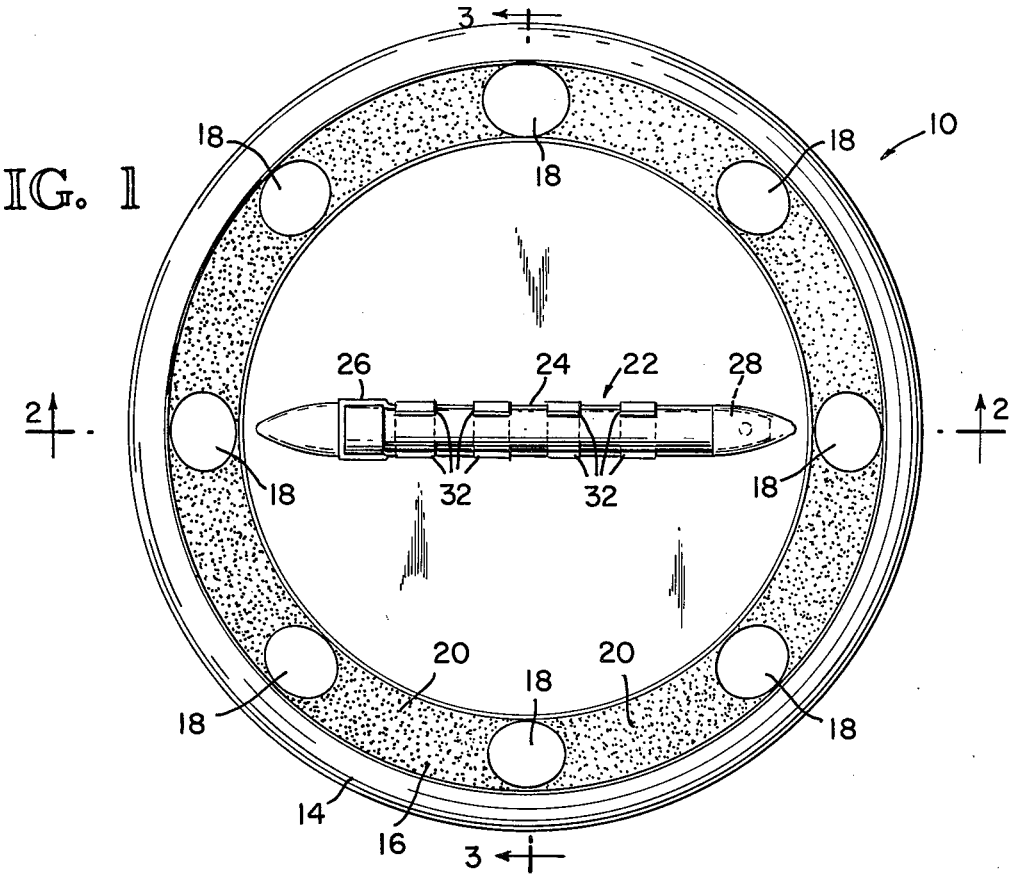
FIG. 1 is a top plan view of the flying saucer toy including the chemical light source.
Figure 2:
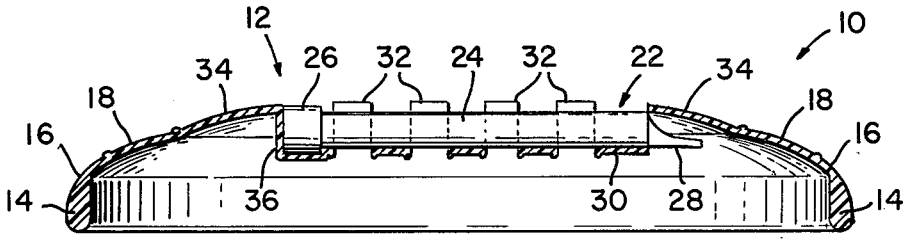
FIG. 2 is a cross-sectional view taken along the line 2—2 of FIG. 1.
Figure 3:
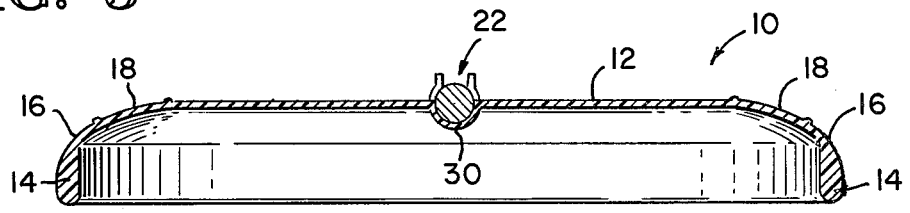
FIG. 3 is a cross-sectional view taken along the line 3—3 of FIG. 1.

The flying saucer toy 10 as illustrated in the drawings includes an annular central portion 12, an annular rim 14 which, as best illustrated in FIGS. 2 and 3 has a convex outer surface and a planar inner surface so that the rim 14 is relatively thick. An annular mid-portion 16 extends from the central portion 12 to the rim 14. The mid-portion 16 contains a plurality of equally spaced portholes or windows 18 surrounded by a textured surface 20.

The structural details of the saucer toy 10 with the exception of the textured surface 20 and windows 18 of the mid-portion 16 are similar to conventional flying saucer toys in common use. Applicant's flying saucer toy includes a chemical light source symmetrically positioned about the center of the central portion 12. One such light source is a chemical light-stick 22 positioned along a diameter of the central portion 12. The light-stick 22 may be a commercially available product sold by American Cyanamid under the trademark "CYALUME". Briefly, the light-stick 22 contains two separate liquids separated from each other by a glass vial. The light-stick 22 is bent in order to break the glass vial thereby mixing the chemicals and causing the light stick 22 to become illuminated. Although the use of a light-stick 22 is described herein, it will be understood that chemical light sources having other shapes and/or chemical compositions may be advantageously employed. The light-stick 22 includes a cylindrical body 24, a generally cyindrical cap 26 and a projecting mounting tab 28. The light-stick 22 is received in a cylindrical cradle 30 formed in the central portion 12 with the light-stick 22 being recessed to a depth of approximately ½ its diameter. A plurality of resilient upstanding fingers 32 integrally formed with the central portion 12 frictionally engages the sidewalls of the body 24 to retain the light-stick 22 in the cradle 30. A pair of generally conical members 34 adjacent the ends of the light-stick 22 provide a smooth transition from the outer surface of the light-stick 22 to the surface of the central portion 12. The conical member 34 adjacent the cap 26 of the light-stick 22 is provided with an inwardly depending wall 36 for preventing axial movement of the light-stick 22. The conical member 34 at the other end of the light-stick 22 does not include this wall 36 so that the hanger portion 28 may be concealed beneath the conical portion 34.

The flying saucer toy 10 is fabricated of a light transmissive material so that light from the light-stick 22 propagates through the central portion 12 and mid-portion 16 to the rim 14 of the flying saucer toy 10. Depending upon the optical properties of the material, variable amounts of light will be emitted from the surfaces of the central portion 12, mid-portion 16 and rim 14. For a more transparent material, light will generally propagate through the central portion 12 and mid-portion 16 without significant loss so that most of the light will be emitted from the toy 10 near the rim 14. A more translucent material will cause light to leak from the toy 10 in the central portion 12 and mid-portion 16. The textured surface 20 of the mid-portion 16 causes a different amount of light to be emitted from the mid-portion 16 than do the smooth surfaces of the windows 18. Thus the windows 18 contrast sharply with the textured surface 20 surrounding the windows 18.

The visual effect of the flying saucer toy is thus highly realistic of fictionalized flying saucers and it allows the flying saucer toy to be used under low light conditions. The light-stick is secured to the toy in a manner which does not adversely affect the aerodynamic characteristics of the toy so that the performance of the toy is not sacrificed by its enhanced visual appearance.

We claim:

1. In a flying saucer toy having a generally planar light-transmissive central portion of circular configuration having upper and lower surfaces, an annular, downwardly depending light transmissive mid-portion surrounding said central portion and an annular, downwardly depending light transmissive rim surrounding said mid-portion, the improvement comprising a chemical light-stick symmetrically positioned about the center of said central portion and secured thereto with said light-stick intersecting the plane occupied by said central portion such that light projects radially from said light-stick directly through an adjacent edge surface of said light transmissive central portion and along the plane of said central portion thereby transferring light substantially throughout said central portion, mid-portion and rim.

2. The flying saucer toy of claim 1, wherein the outer surface of said mid-portion is roughly textured to facilitate the emission of light from said mid-portion.

3. The flying saucer toy of claim 2, wherein said mid-portion further includes a plurality of spaced apart windows having a smoothly textured outer surface to restrict the emission of light from said windows such that said windows contrast sharply with the surrounding roughly textured surface of said mid-portion.

4. The flying saucer toy of claim 1, wherein said toy further includes an elongated, semi-cylindrical cradle receiving said light-stick, said cradle having an upwardly facing opening extending along a diameter of said central portion, receiving said light-stick and means for securing said light-stick within said cradle such that shock imparted to said flying saucer toy as said toy drops onto a surface is incapable of dislodging said light-stick from said cradle.

5. The flying saucer toy of claim 4, wherein said means for securing said light-stick within said cradle includes a plurality of resilient fingers projecting upwardly from said central portion along opposite sides of said light stick, said fingers frictionally engaging said light-stick to retain said light-stick in said cradle.

6. The flying saucer toy of claim 5, wherein said light-stick includes a cylindrical body having a constant diameter throughout and a single cylindrical cap covering one end thereof having a circular end portion covering an enlarged diameter cylindrical portion, and wherein said cradle includes a wall at one end thereof abutting the end portion of said cap to prevent axial movement of said light-stick in one direction and wherein at least one of said fingers contacts the body of said light-stick closely adjacent the cylindrical portion of said cap opposite said end portion to prevent axial movement of said light-stick in an opposite direction.

7. The flying saucer toy of claim 4, further including transition members for smoothly fairing said light-stick to the generally planar surface of said mid-portion thereby reducing the rotational resistance produced by said light-stick and facilitating the retention of said light-stick within said cradle.

8. The flying saucer toy of claim 7, wherein said light-stick includes an axially projecting hanger at one end thereof and wherein said transition member encloses said hanger member.

* * * * *